US005953919A

United States Patent [19]

Meylan

[11] Patent Number: 5,953,919

[45] Date of Patent: Sep. 21, 1999

[54] COMBUSTION CHAMBER HAVING INTEGRATED GUIDE BLADES

[75] Inventor: Pierre Meylan, Neuenhof, Switzerland

[73] Assignee: Asea Brown Boveri AG, Baden, Switzerland

[21] Appl. No.: 08/966,865

[22] Filed: Nov. 10, 1997

[30] Foreign Application Priority Data

Dec. 13, 1996 [DE] Germany ..... 196 51 881

[51] Int. Cl.[6] ..... F02C 7/18

[52] U.S. Cl. ..... 60/752; 60/760

[58] Field of Search ..... 60/39.36, 39.37, 60/722, 752, 760; 415/115

[56] References Cited

U.S. PATENT DOCUMENTS

| | | | |
|---|---|---|---|
| 2,477,683 | 8/1949 | Birmann | 60/39.36 |
| 2,630,679 | 3/1953 | Sedille | 60/760 |
| 3,316,714 | 5/1967 | Smith et al. | 60/752 |
| 3,608,310 | 9/1971 | Vaught | 60/752 |

FOREIGN PATENT DOCUMENTS

| | | |
|---|---|---|
| 0564183A1 | 10/1993 | European Pat. Off. . |
| 1476887 | 9/1969 | Germany . |
| 1476892 | 7/1970 | Germany . |
| 3711024A1 | 10/1987 | Germany . |

*Primary Examiner*—Louis J. Casaregola
*Attorney, Agent, or Firm*—Burns, Doane, Swecker & Mathis, L.L.P.

[57] ABSTRACT

A gas turbine having guide blades arranged between the combustion chamber and turbine rotor is improved by the guide blades 1.1 being integrated in the respectively associated combustion chamber 1.2. That is, the guide blades 1.1 and the associated combustion-chamber wall 1.2.1 are designed essentially in one piece and are constructed as a combustion-chamber/guide-blade unit 1. The latter sits in cold supporting structures 3.1 of the gas-turbine plant 3 and both together form cooling-air passages which allow the combustion chamber to be cooled in counterflow.

7 Claims, 2 Drawing Sheets

COMBUSTION CHAMBER HAVING INTEGRATED GUIDE BLADES

BACKGROUND OF THE INVENTION

1. Field of the Invention

The invention relates to a gas turbine having guide blades arranged between the combustion chamber and turbine rotor.

2. Discussion of Background

Between the combustion chamber and turbine rotor, a gas turbine has a guide-blade group which forms an independent unit, is essentially separated in terms of function and design from the adjacent subassemblies, such as the combustion chamber and turbine rotor, and also has separate fixings in the turbine casing. This has the disadvantage that each of these subassemblies has to be separately manufactured and separately assembled and in particular also adjusted with respect to one another, which entails very high costs. In particular, such a type of construction requires a very large number of components with all the complex disadvantages, from the production and assembly operations, the transport weight, through in particular to the thermal operating behavior.

SUMMARY OF THE INVENTION

Accordingly, in attempting to avoid all these disadvantages, one object of the invention is to provide a novel gas turbine having guide blades which are arranged between the combustion chamber and turbine rotor and avoid the expensive separate production and assembly in addition to the subassemblies of each combustion chamber.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1:
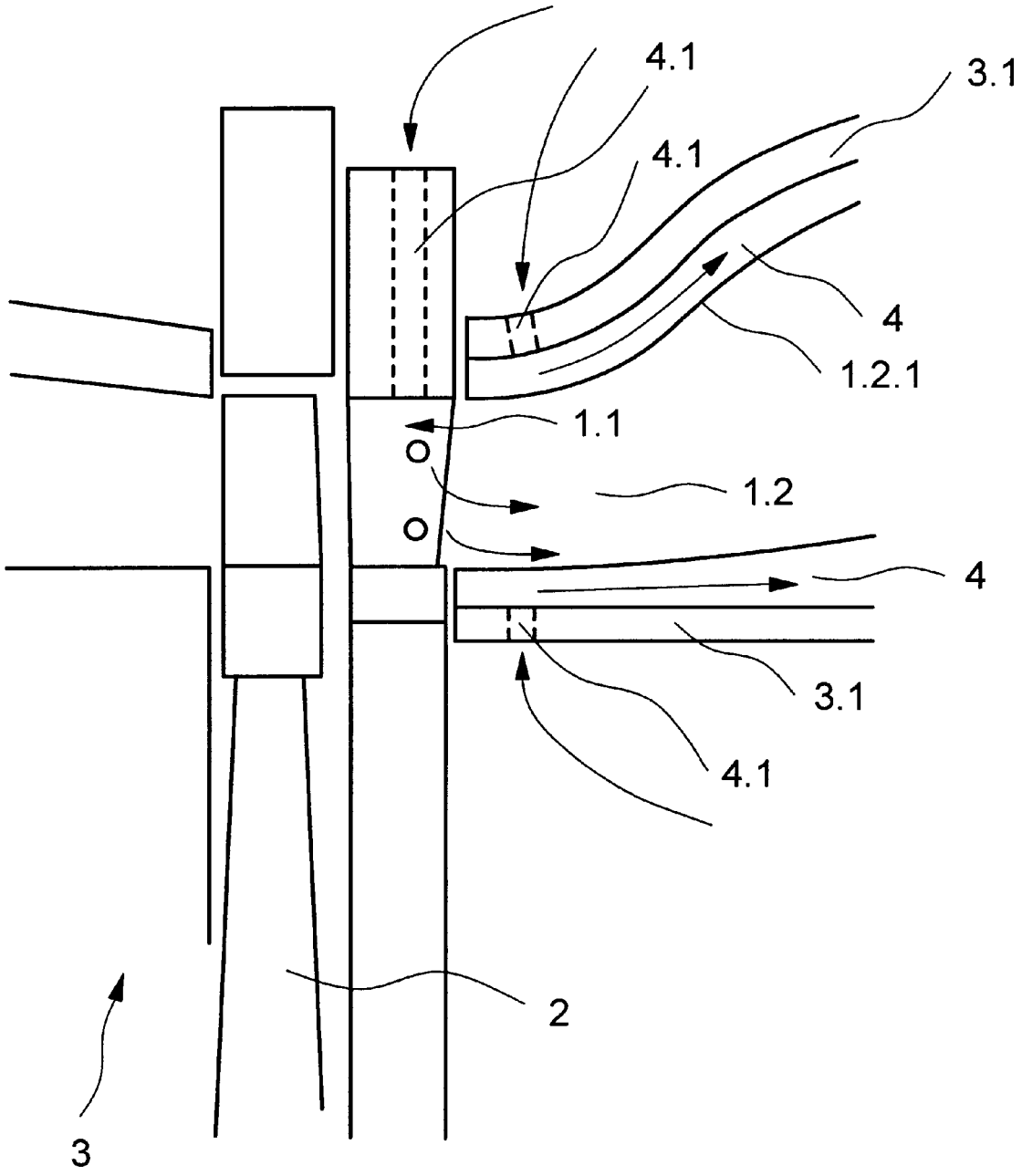
FIG. 1 PRIOR ART
FIG. 1 schematically shows a guide-blade arrangement according to the prior art.
Figure 2:
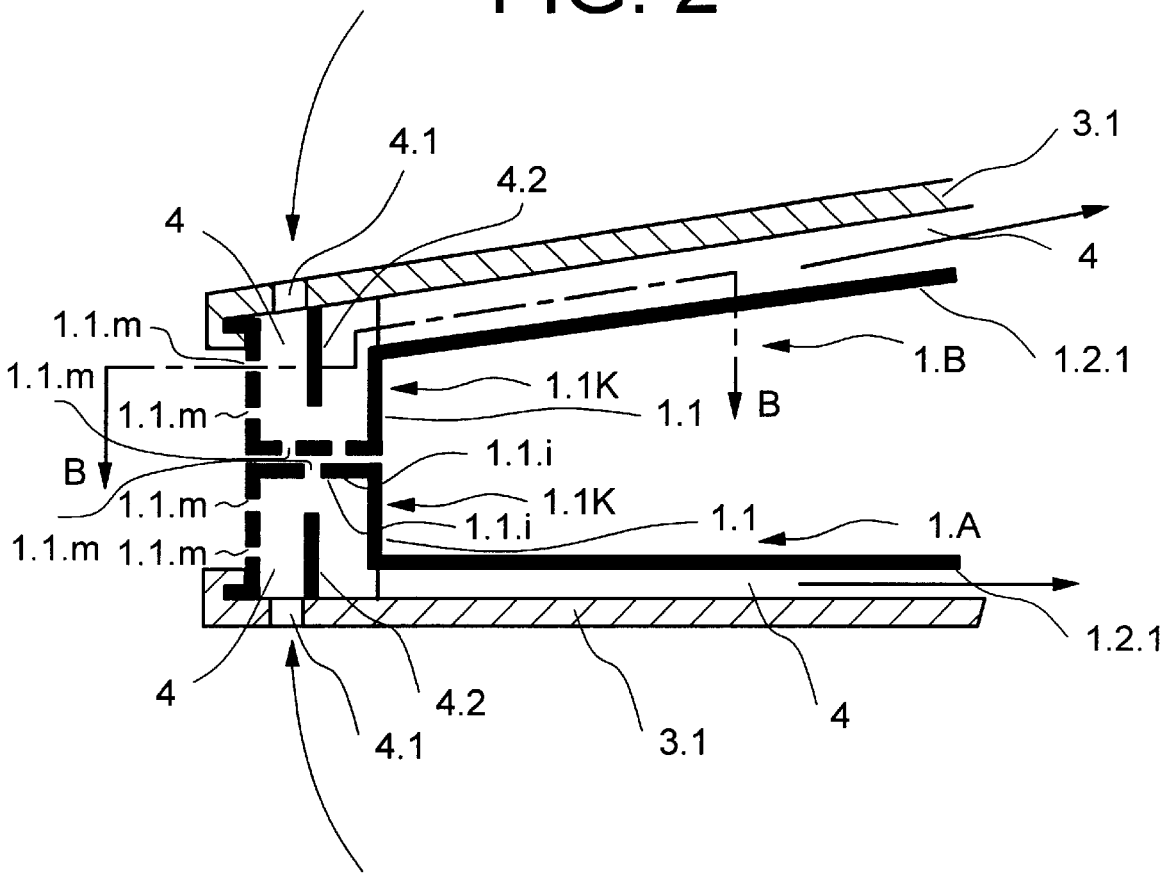
FIG. 2 shows an essentially radial section through a guide-blade arrangement according to the invention (section AA)
Figure 3:
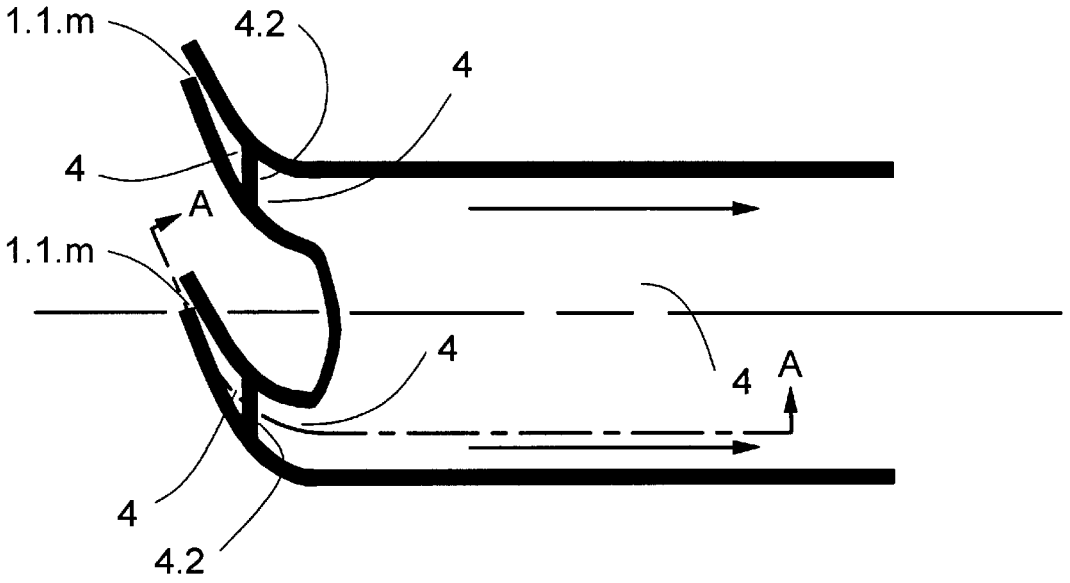
FIG. 3 shows the section BB through two adjacent guide blades of a guide-blade group.

Only the elements essential for understanding the invention are shown; in particular, the unaltered gas-turbine part known per se is not shown.

DESCRIPTION OF THE PREFERRED EMBODIMENTS

Referring now to the drawings, wherein like reference numerals designate identical or corresponding parts throughout the several views, in a gas turbine in which guide blades 1.1 are arranged between each combustion chamber 1.2 and the turbine rotor 2, according to the invention said guide blades are integrated in the combustion-chamber wall 1.2.1 and are designed as parts of the same. They represent an essentially monolithic combustion-chamber/guide-blade unit 1. The combustion-chamber wall 1.2.1 merges into the wall of each associated guide blade 1.1 without being separate from it. This combustion-chamber/guide-blade unit 1 is inserted into a so-called cold supporting structure 3.1 of the gas-turbine plant and is supported by the latter. For assembly reasons in respect of the entire gas-turbine plant, this combustion-chamber/guide-blade unit 1 is of a split design, which results in a radially outer and a radially inner segment 1.B and 1.A respectively, the guide-blade halves being separated from one another in each segment by corresponding boundary walls 1.1.*i*, that is to say each guide blade 1.1 has an outwardly closed-off radially inner and radially outer part, each in a corresponding segment 1.A and 1.B respectively. Each of these segments sits in an allocated cold supporting structure 3.1 of the gas-turbine plant. Provided between each of these cold supporting structures 3.1 and the segment 1.A or 1.B allocated to it are, cooling-air passages 4 which run partly in the interior of the guide blades 1.1. In this case, the inflow openings 4.1 of the cooling-air passages 4 are arranged in the cold supporting structure 3.1 in the region of the guide blades 1.1, as a result of which counterflow cooling of the combustion-chamber wall 1.2.1 is realized. In order to cope with the thermal conditions, guide devices 4.2, e.g. baffle plates or guide plates, for the cooling air are provided in the cooling-air passages 4 of the guide blades 1.1. The boundary walls 1.1.*i* of segments corresponding to each guide-blade half thus formed, which boundary walls split the guide blade 1.1 in radial direction and are adjacent to one another, may have at least one step 1.1.*k* corresponding to the adjacent boundary wall 1.1.*i* and intended as a sealing element for reducing leakage losses. In addition, each of the guide blades 1.1 has cooling-air openings 1.1.*m* on its shell sides, these cooling-air openings preferably, and depending on the thermal conditions, being arranged on the rotor side (trailing edge) or in the region of the boundary walls 1.1.*i* splitting the guide blade 1.1 into two radial segments. In this case, these cooling-air openings 1.1.*m* in the boundary walls 1.1.*i* are staggered from inner segment 1.A to outer segment 1.B.

The splitting of the guide blade 1.1 into the radially inner and the radially outer segment 1.A and 1.B respectively may lie between a level located radially entirely on the inside and a level located radially entirely on the outside (0% and 100% of the passage height), depending on specific plant conditions, i.e. for optimum production (casting technique), and the cooling conditions.

The boundary walls 1.1.*i* of segments corresponding to each guide-blade half, which boundary walls split the guide blades 1.1 and are adjacent to one another, may be arranged at any inclination to the rotor axis.

With this integrated design of the guide blades, they constitute a continuation of the combustion chamber with the additional task of deflecting the gas flow to the moving blades of the turbine wheel. The guide-blade row, which in general has a very complex structure, is of separate construction and is to be assembled separately, can thus be dispensed with. This also results in the reduction or elimination of cooling-air losses (leakage) through gaps caused during assembly.

In addition, the cooling air is fed again almost completely to the combustion cycle, in the course of which it is already preheated very effectively by the counterflow guidance. Due to the integrated type of construction, the cooling-air losses can be greatly reduced. In addition, the counterflow guidance of the cooling air ensures that the guide blades subjected to very high thermal loading receive the fresh and thus colder cooling air and are therefore cooled more effectively. In addition, the length of the combustion chamber with integrated guide blade can be shortened by approximately the axial extent of the first guide-blade row. This also results in the advantage that the cooling air for the first moving-blade row of the first turbine can be fed to the moving-blade row no longer by the guide-blade row but directly from the compressor. This therefore results in a distinct shortening of the cooling-air path and thus in a reduction in the flow losses and in the surface to be cooled; it also results in a simpler design of the corresponding plant parts. In addition, due to the splitting into the two segments of the combustion-chamber/guide-blade unit 1, the advantage can be realized that the cooling-air heating is distributed roughly uniformly between the radially outer and the radially inner segments.

Since the cooling-air flows are arranged essentially in series according to the invention, substantial advantages concerning the efficiency of the cooling are also obtained compared with the parallel arrangement of the cooling-air flows according to the prior art. In addition, the leakage losses of cooling air through the gaps in the vicinity of the separately produced and inserted guide blades do not occur in the case of the integrated guide-blade design.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A gas turbine comprising:

a turbine rotor;

a combustion chamber formed by a combustion chamber walls;

at least one guide blade disposed between said combustion chamber and said turbine rotor, said at least one guide blade formed integrally with said combustion chamber walls thereby defining a monolithic member therewith;

at least one cold supporting structure, said monolithic member being supported within said at least one cold supporting structure; and at least one cooling air inlet disposed proximate to said at least one guide blade; and at least one cooling air passage, said cooling air passage having at least a first segment inside a guide blade, and a second segment extending essentially along said combustion chamber walls, said second segment in direct serial communication with said first segment, and said at least one cooling air passage in direct serial communication with said cooling air inlet.

2. The turbine of claim 1, wherein said at least one cold supporting structure and said monolithic define said cooling air passages, said cooling air inlet disposed in said at least one cold supporting structure.

3. The turbine of claim 2, further comprising guide members disposed within said cooling air passages.

4. The turbine of claim 1, wherein the integrally formed at least one guide blade and combustion chamber walls further comprise a radially inner segment and a radially outer segment, said segments having boundary walls.

5. The turbine of claim 4, wherein said boundary walls are inclined relative to the axis of said rotor.

6. The turbine of claim 1, wherein said at least one guide blade has cooling air opening disposed on shell sides thereof.

7. The turbine of claim 4, further comprising cooling air openings disposed along said boundary walls.

* * * * *